US009683823B2

(12) United States Patent
Holland

(10) Patent No.: US 9,683,823 B2
(45) Date of Patent: Jun. 20, 2017

(54) BULLET COMPARATOR

(71) Applicant: Darrell Holland, Powers, OR (US)

(72) Inventor: Darrell Holland, Powers, OR (US)

( * ) Notice: Subject to any disclaimer, the term of this patent is extended or adjusted under 35 U.S.C. 154(b) by 142 days.

(21) Appl. No.: 14/626,615

(22) Filed: Feb. 19, 2015

(65) Prior Publication Data

US 2015/0233689 A1 Aug. 20, 2015

Related U.S. Application Data

(60) Provisional application No. 61/942,235, filed on Feb. 20, 2014.

(51) Int. Cl.
*F42B 35/02* (2006.01)

(52) U.S. Cl.
CPC ..... *F42B 35/02* (2013.01)

(58) Field of Classification Search
CPC ..... F42B 35/02
USPC ..... 33/506; 73/167
See application file for complete search history.

(56) References Cited

U.S. PATENT DOCUMENTS 9,513,097 B1 * 12/2016 Sheridan ..... F42B 35/02
2013/0219728 A1 * 8/2013 Hartman ..... G01B 3/205 33/506

* cited by examiner

*Primary Examiner* — Michael A Lyons
*Assistant Examiner* — Jean Morello
(74) *Attorney, Agent, or Firm* — Timothy E. Siegel Patent Law, LLC; Timothy E. Siegel

(57) ABSTRACT

The present invention provides a device and method for improved, repeatable, consistent, rapid, and accurate measurements of a bullet using a dial indicator. The bullet comparator of the present invention consists of a fixture block having a V-shaped groove running along a long axis of the block and a dial indicator coupled to one end of the fixture, configured so its probe operably moves toward the center of the fixture. A stop block adjustably positions in the V-shaped grove of the fixture. And, at least one floating chamber selectively positions in the V-shaped grove of the fixture. The floating chamber is a cylindrical body defining an interior chamber; the interior chamber has a first ring-contact and at least a second ring-contact on an interior portion of the chamber.

13 Claims, 5 Drawing Sheets

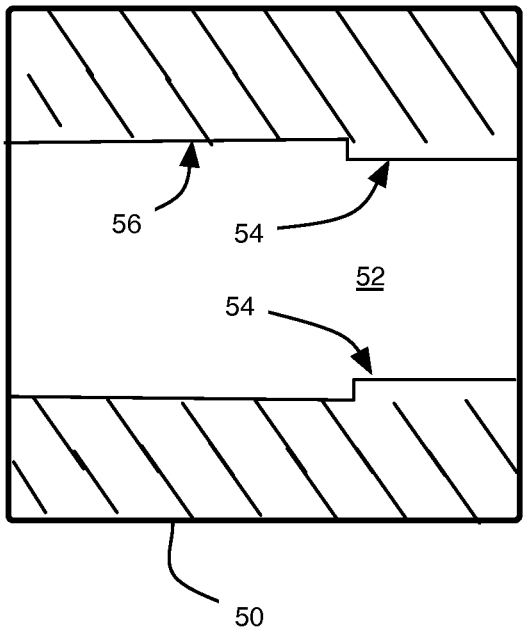
FIG. 2
FIG. 3
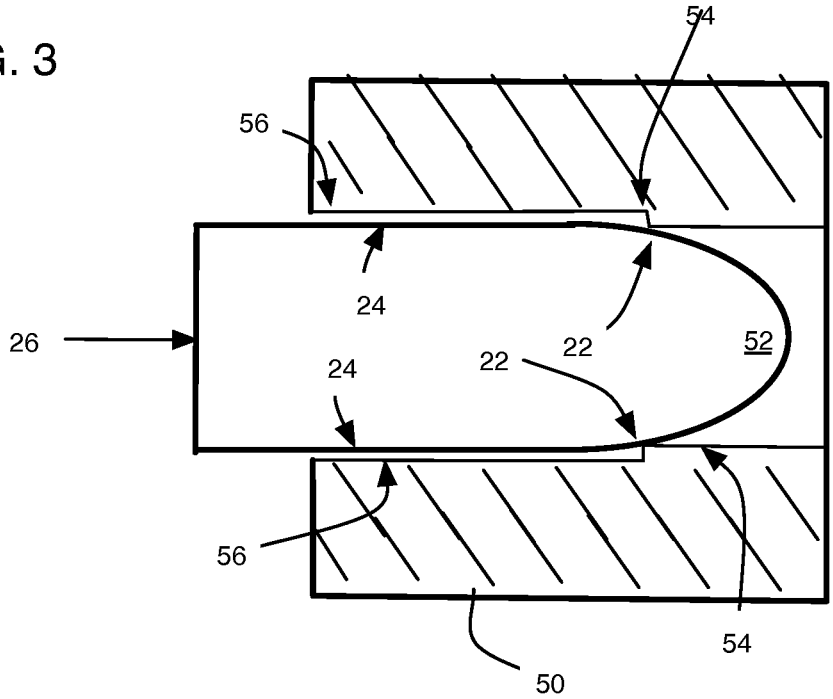

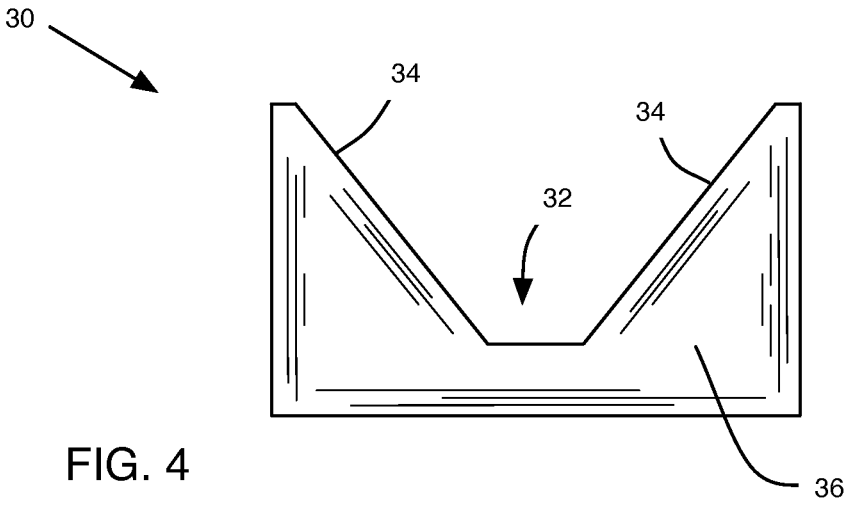
FIG. 4
FIG. 5
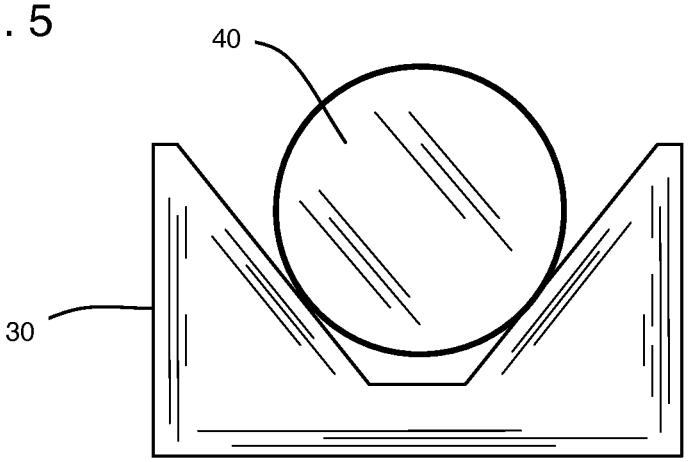

BULLET COMPARATOR

PRIORITY CLAIM

The present application is based on, and claims priority to for all purposes, provisional patent application No. 61/942,235, filed on 20 Feb. 2014 having the common inventor named above.

FIELD OF THE INVENTION

The present invention relates to systems, methods, and devices used to precisely, accurately, and repeatedly determine the overall length of a small-arms ballistics (bullets).

BACKGROUND

The current teaching in the art relies heavily on user skill and dexterity to determine the size (overall length) of a bullet. Common bullet comparators rely upon the user's ability to juggle the bullet into place to hopefully find a datum line from which to measure. This datum line, however, is a constructed line that relies on a visual queue based on a single ring-contact line, or datum-line, established by a fixture holding the bullet around its circumference and a single touch-point on the bullet's base, where the measuring instrument contact's the bullet. However, this approach causes considerable variability because repeatable and proper alignment of the bullet by the ring-contact fixture is imprecise.

The current art uses a dial caliper in conjunction with a ring-contact fixture. The bullet is placed in the ring-contact fixture; however, it is very easy to misalign the bullet in the fixture. To overcome this, and to establish the needed datum line, the user typically juxtaposes the bullet so that the calipers function more akin to a "C"-clamp, with the bullet precariously balanced between the caliper jaws. Then, the user pushes harder and harder to square the bullet in the ring-contact fixture using one caliper jaw on the base of the bullet and the other jaw pushing on the far end of the ring-contact fixture. And the, the user reads the measurement on the dial caliper.

The ring-contact fixture of the existing art is typically a hexagonal shaped fixture, similar in appearance to a "hex nut" with a uniquely dimensioned bore hole on each face. A common problem with this fixture is that a bullet can be off-center in the borehole, thus making repeatable measurements on the same bullet difficult.

Thus, there is a need for a bullet comparator that improves repeatability and accuracy of measurements. Such an improved comparator should utilize existing measurement instruments, such as a dial indicator, for example. Further, such an improved comparator should reduce or eliminate variability from off-center placement of the bullet in the fixture. Such an improved comparator should be reliable, repeatable, and easy-to-use.

SUMMARY OF THE INVENTION

The present invention in its various preferred embodiments overcomes the limitations of the existing state of the art for determining bullet size. The present invention consists of an improved bullet comparator having a dial indicator mounted to a fixture having a V-shaped grove and a floating bullet chamber adapted to slide along the V-shaped grove of the fixture. An adjustable stop block accommodates bullets of different lengths.

The unique floating bullet chamber of the present invention holds the bullet's base square to the bullet's central axis and datum line. The floating bullet chamber uses a multiple point contact geometry inside the fixture to provide a first ring-contact line about the bullet's circumference and at least one additional (second) ring-contact line. This ensures a repeatable and consistent placement of the bullet in the chamber each and every time a bullet is placed in the floating bullet chamber.

Spring tension caused by the operation of the dial indicator against the bullet, which is supplied by the internal spring of the dial indicator, provides a consistent and uniform compression of the bullet into the floating chamber. This ensures repeatability to plus or minus 0.0002-0.0003 of an inch.

To accommodate various sizes and shapes of bullets, the present invention in alternative embodiments includes corresponding floating chambers for all bullet sizes.

The operation of the improved comparator of the present invention is the same no matter what size of bullet is used: The user places the nose of the bullet into the floating chamber, selected by the nominal gauge of the bullet, the bullet and chamber are then placed in the V-shaped grove of the fixture and the dial indicator is then placed against the base of the bullet and the reading is taken.

The various embodiments of the floating chamber of the present invention align the bullet for precise and repeatable measuring regardless of bullet shape; whether the bullet has a flat base, boat-tail, tangent ogive and secant ogive bullets are compatible with these floating holders.

The speed and rapidity at which one can precisely sort bullets is un-equaled with this gauge. The stationary base and gauge design allows the user to use both hands to sort bullets. One gently inserts a bullet into the correct size floating chamber, retracting the dial stem and inserting the bullet tip into the relief hole in the adjustable stop block. The floating chamber is nestled in the V-shaped grove of the precision Fixture and the dial stem compresses the bullet against the datum contact point within the floating chamber. The reverse procedure is used to remove the bullet and floating chamber the bullet is ejected from the floating chamber with the middle finger to the specific container based on its dimension.

DRAWING

FIG. 2 is a cross sectional side view of a floating chamber of the bullet comparator of FIG. 1.

FIG. 3 is a cross sectional side view of the floating chamber of FIG. 2 with a bullet positioned in the chamber for measurement.

FIG. 4 is an end view of the fixture of the bullet comparator of FIG. 1.

FIG. 5 is an end view of the fixture of FIG. 4 with a stop block coupled to the Fixture.

DESCRIPTION OF THE INVENTION

Possible embodiments will now be described with reference to the drawings and those skilled in the art will understand that alternative configurations and combinations of components may be substituted without subtracting from the invention. Also, in some figures certain components are omitted to more clearly illustrate the invention.

The disclosure uses the term bullet, cartridge, and fire arm projectile interchangeably. This use should not be limiting and refers generally to a typically metal projectile in the shape of a pointed cylinder that is expelled from a firearm, especially a rifle or handgun. This projectile further typically includes a metal casing.

Figure 7:
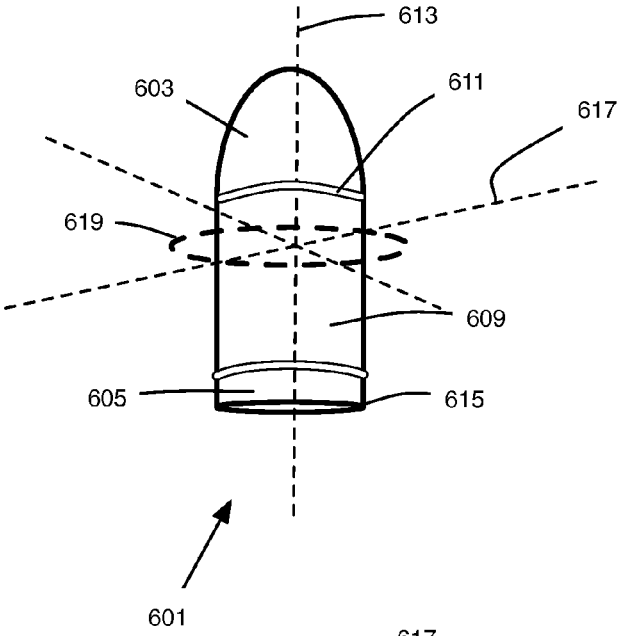
FIG. 7 is an offset frontal view of the bullet of FIG. 6.
Figure 6:
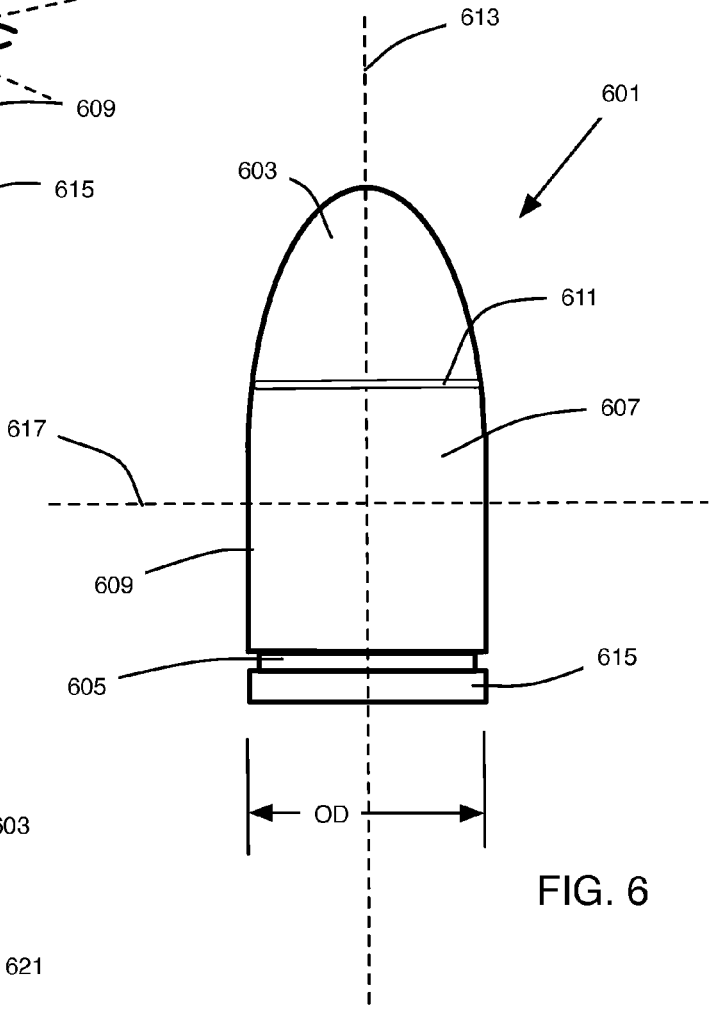
FIG. 6 is a front view of a bullet and is used to illustrate reference features of the bullet as contemplated by various preferred embodiments of the present invention.

FIGS. 6 and 7 illustrate a representative bullet of a given gauge and these figures will aid in understanding some of the terminology used herein. A typical bullet 601 includes a nose 603 at a distal end and an opposite base 605 at a proximal end. A bullet body 607 links and is intermediate to both the nose and base. More particularly, the body of the bullet includes the case 609 and crimp 611, which is located where the projectile end (including the nose 603) is mechanically joined to the case. The case includes the combustible fuel that ignites, explodes and directs the projectile. A primer (not shown in these figures) seats in the base (proximal end) of the bullet, centered about a long axis 613 of the bullet. The terminus at the proximal end is termed the rim 615. A constructed datum line 617 runs perpendicular to the long axis—ideally and theoretically, the rim of the bullet is parallel to this datum line and lies in a plane perpendicular to the long axis 613—however, in reality, manufacturing tolerances and the mechanical process of seating primers, crimping the case to the projectile, and packing the case can result in imperfect geometries, thus resulting in offset rims relative to the long-axis of the bullet. And, a true circumferential datum 619 is represented in FIG. 7 as in a plane perpendicular to the long axis.

One common problem of known measuring methods of the prior art includes using calipers across the bottom of the bullet. Theoretically, one jaw of the calipers would contact the plane defined by the rim of the bullet and this plane (theoretically) would be perpendicular to the long axis of the bullet. The second jaw of the caliper is place on the nose of the bullet. This technique introduces considerable error for two obvious reasons: First, the base of the bullet is likely not square to the long axis of the bullet and, second, it is nearly impossible to precisely locate the second jaw on the nose of the bullet's rounded feature. Further, placing the bullet on a fixture block so that the base of the bullet contacts the flat surface of a conventional fixture block fall victim to the same problem of a non-square bullet base.

The present invention, in all of the following embodiments, recognizes that a superior method of measuring the length of a bullet requires utilizing the most stable geometries of the bullet to an advantage. This requires fixturing the bullet in such a way to minimize the error introduced by referencing a measurement from the rim and, further, to eliminate using the extreme tip of the nose of the bullet as a reference point for a measuring instrument. Accordingly, the contemplated preferred methods and devices of the present invention fixture a bullet in a close-tolerance fixture that includes a unique floating chamber 50.

Figure 8:
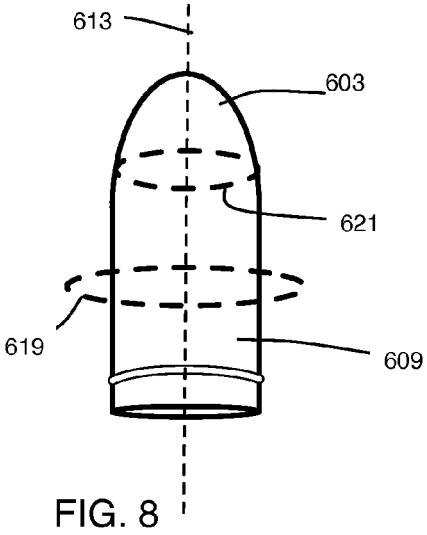
FIG. 8 is another offset frontal view of the bullet of FIG. 6.

Referring now to FIG. 8, the method and devices of the present invention create a first ring contact on a bullet about a circumference 621 on the nose of the bullet (but not at the tip). This ring contact circumference 621, by means of the floating chamber 50 (not shown in FIG. 8) design, results in a near perfect square alignment (that is to say the plane in which the ring 621 lies in is at perpendicular or very near perpendicular to the long axis 613). Further, the floating chamber orients the bullet so that the base of the bullet is contacted by a probe at or very near the dead-center of the base, thus eliminating any out-of-square condition the base may have acquired during various assembly stages or due to tolerance stack up. The floating chamber includes a long, narrow, shaft that is intentionally sized to have an inner diameter of 0.001 inch larger than the outside diameter of the bullet. The combination of this tight tolerance and the relatively long and narrow shaft ensures that the ring circumference contact 621 is perpendicular to the long axis 613 of the bullet. For example, a floating chamber designed for a "44" Remington Magnum (0.44) would use a bullet casing having an overall outside diameter of 0.429-inches—accordingly, the inside diameter of the "floating" portion of the chamber, the slightly larger second diameter 56, would be 0.430-inches, and the diameter of the first ring contact (smaller) diameter 54 would be 0.428-inches.

To achieve this aforementioned method of measuring a bullet, the present invention contemplates both steps and a unique device that enables those steps to be achieved in a reliable and repeatable manner. Thus, according to one preferred embodiment of the present invention, and as FIGS. 1-5 illustrate, for example, an improved bullet comparator 10 uses a standard dial indicator 12. The dial indicator 12 is mounted to a fixture 30 by a mounting block 34. The probe 14 of the indicator 12 inserts through an opening in the mounting block. The probe is free to operate normally, and the indicator's internal spring will push the tip of the probe toward the center of the fixture 30. Although this invention mentions the use of dial indicators, electronic indicators would work equally well and can be readily interchanged—thus, the use of the term "dial indicator" should not be limiting and, instead, be interpreted as exemplary. Examples of suitable indicators include, for example and not limited to, a Mahr-Federal brand 1075 R model electronic indicator or a Mahr-Federal brand 121-RC model dial indicator, both are available from www.store.Gauging.com of Portland, Oreg.

Figure 1:
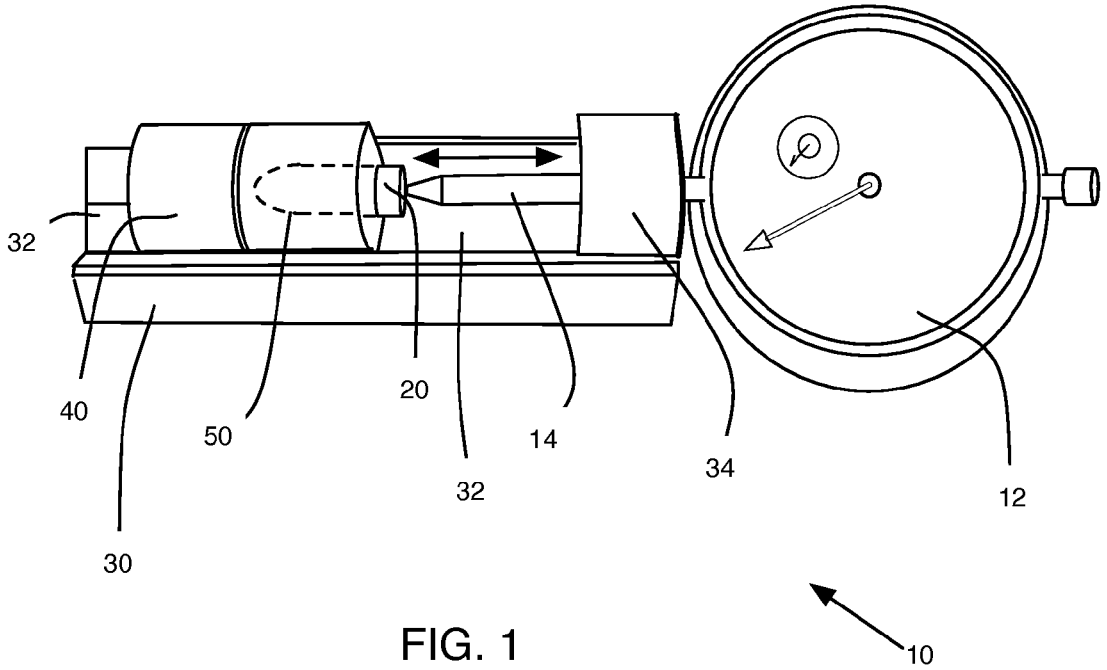
FIG. 1 is an offset frontal view of a preferred embodiment of a bullet comparator according to the present invention.

The indicator 12 arranges parallel to a long axis of the fixture 30. The long axis, as illustrated in FIG. 1 for example, extends horizontally, left to right on the sheet of paper. At rest, the probe of the indicator has a spring bias causing the probe to move and extend horizontally to the left, using FIG. 1 as reference for these arbitrary references, which are not intended to limit the invention, but rather to provide greater clarity to the reader of the relative juxtaposition of various elements of the present invention. Measurement by the dial indicator if facilitated when the probe contacts an item, thus causing the probe's tip to make relative movement to the right, compressing the spring of the dial indicator, as would be well understood by those of ordinary skill in the art.

The fixture 30 also includes a longitudinal running (from left to right in FIG. 1, for example) V-shaped groove 32 for the entire, or optionally, a substantial portion, of the length of the fixture 30. At an end opposite the indicator 12, a positionable stop block 40 is configured to selectively couple on the fixture at any desired distance from the dial indicator. The position of the block can be adjusted by one or more set screws adapted to engage a portion of the fixture 30 whereby tightening of the one or more set screws fixes the block in relative position and loosening the one or more set screws enables the block to slide left and right (relative to the surface of the sheet of paper of Figure one when oriented in portrait position), or the block can be completely removed from the fixture. Other mechanisms for selectively positioning and securing the stop block in a given desired position are contemplated and the aforementioned disclosure should not be limiting. Those skilled in the art will appreciate that the adjustability and lockability of the block on the fixture can be used to "zero" the indicator 12 at a particular distance relative to the setup used on the fixture, by moving the stop and leaving the indicator in a fixed relative position on the fixture.

The comparator further includes one or several floating bullet chambers 50. Each chamber is sized for a particular gauge of bullet. Each respective chamber 50 is configured to rest in the V-shaped groove 32 and fit securely against the stop block 40. A bullet 20 inserts, nose first, into an opening on the chamber 50 and the probe contacts the base of the bullet 26 so that a measurement can be read on the dial.

One important aspect of the floating chamber 50, is that bullet is supported in such a way as to create a very stable platform from which to take reliable, repeatable and precise measurements of the bullet using a standard dial indicator configured in the fixture 30, as described above. For reference, FIGS. 6, 7, and 8 illustrate a representative bullet 601. In FIG. 6, a front view of the bullet, a bullet arranges so its long axis 613 runs vertically, that is to say, up and down relative to the face of the sheet of paper, as described above.

Now making specific reference to FIGS. 2 and 3, a cross-sectional side view of the floating chamber 50 reveals a first ring contact diameter 54 well inside the floating chamber's interior chamber 52. This smaller diameter creates a first contact point with the bullet—this contact point is actually a contact ring or circumference as represented in FIG. 8 as circumference 621, located on a portion of the nose 603 of the bullet 601, but not at the tip of the nose. A slightly larger second diameter 56, which is substantially about 0.001-inches larger than the first contact diameter 54, serves to align the bullet in direct parallel orientation with the V-shaped grove and thus presents the base of the bullet square with the probe of the dial indicator. This second diameter 56, moreover, is about 0.001-inches larger than the overall diameter of a given bullet for which the floating chamber is designed to support. Accordingly, different gauged bullets may each require their own unique floating chamber—however the principles remain the same regardless of bullet size and geometry.

Figure 9:
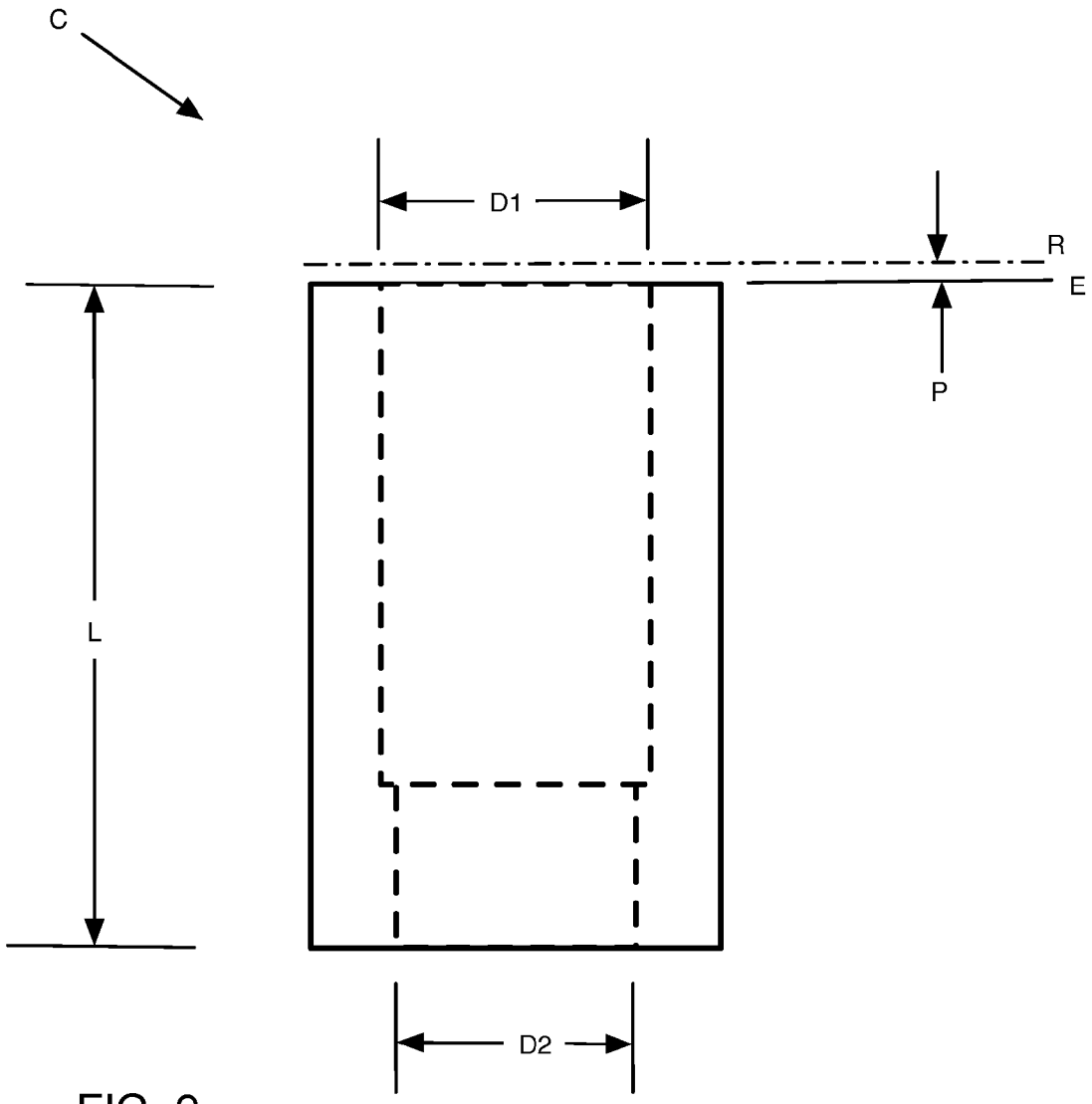
FIG. 9 is a front view of a floating chamber according to one embodiment of the present invention.

The sidewall creates a second ring-contact diameter 56, but is more appropriately a "floating" chamber whereby the tolerance is such that the bullet body is aligned perfectly squarely with the chamber and is unable to be positioned off-center or skewed. When a bullet 20 is inserted nose first into the chamber 50, two ring contact lines are established. A first ring contact line 22 corresponds to the chamber's first ring-contact diameter 54 and a second ring contact line 24 corresponds to the chamber's second ring-contact diameter 56. This sidewall, or more accurately, a long, narrow shaft, facilitates the "floating" concept by having a relatively long or deep length relative to the inside diameter of the chamber. The overall length L of the floating chamber should be as long as possible for a given caliber of cartridge, so long as the base of the cartridge extends outside the chamber. The minimum length L is about 1.5 times the bullet diameter. The maximum length also depends on the caliber of the bullet being measured using the floating chamber, this length should be maximized so long as a bullet in the floating chamber C would have its base extending at least 0.001-inch (represented by reference line R in FIG. 9) from the edge E (top of floating chamber). The inner diameter D1 of the chamber C is about 0.001 to 0.0015-inch larger than the nominal outer diameter of a given cartridge and the first ring contact diameter D2 is about 0.001 to about 0.0015-inch less than the same nominal outer diameter (OD, see FIG. 6) of the bullet or cartridge of interest. See FIG. 9, for example.

The probe 14 of the indicator 12 contacts the base of the bullet at a contact point 26. This contact point can be at or very near the geometric dead-center of the base of the bullet. Accordingly, a given bullet can be measured repeatedly using this comparator of the present invention resulting in highly accurate and repeatable measurements that represent the true overall length of the bullet.

Thus, in combination with the first and second ring contact line/diameter, the unique floating bullet chamber of the present invention holds the bullet's base square to the bullet's central axis and datum line. The floating bullet chamber uses a multiple point contact geometry inside the fixture to provide a first ring-contact line about the bullet's circumference and at least one additional (second) ring-contact line. This ensures a repeatable and consistent placement of the bullet in the chamber each and every time a bullet is placed in the floating bullet chamber.

Spring tension caused by the operation of the dial indicator against the bullet, which is supplied by the internal spring of the dial indicator, provides a consistent and uniform compression of the bullet into the floating chamber. This ensures repeatability of the overall length measurement of plus or minus 0.0002-0.0003 of an inch.

To accommodate various sizes and shapes of bullets, the present invention in alternative embodiments includes corresponding floating chambers for all bullet sizes.

Making specific reference to FIG. 4, the V-shaped grove 32 of the fixture 30 includes sloping sidewalls 34. FIG. 5 shows a stop block 40 mounted in the V-shaped grove 32.

The fixture 30, mounting block 34, floating chamber 50, and stop block 40 can be machined from blocks of aluminum, brass, platinum, gold, steel, stainless steel, their alloys, or other durable materials that have predictable dimensional stability. Any standard dial indicator, as understood by those skilled in the art would work in this context. And other measurement instruments can be modified to work with the concepts and scope of the present invention.

Although the invention has been particularly shown and described with reference to certain embodiments, it will be understood by those skilled in the art that various changes in form and detail may be made without departing from the spirit and scope of the invention.

I claim:

1. A comparator device using an indicator having a moveable probe adapted for measuring the length of a cylindrical object having a base and a rounded nose, from base to nose, the device comprising:

a fixture having a longitudinal upwardly facing surface and including a mounting element on a first longitudinal end of the upwardly facing surface and a stop element at a second longitudinal end of the surface, opposed to the first end;

wherein the indicator is coupled to the mounting element and configured so the probe of the indicator can move parallel to the upwardly facing surface, toward the stop element;

and at least one object holder removably supported on the upwardly facing surface, having a first end that abuts the stop element so as to prevent movement away from the indicator, and a second end that faces the indicator, and defining a cylindrical chamber, open at the second end, and having a first inner diameter, and having a ring, having a second inner diameter, smaller than the first inner diameter, inward of the second end, and the chamber configured to receive the cylindrical object so a circumference of the nose abuts the ring and the base is aligned to and accessible to the probe.

2. The device of claim 1 wherein the object holder further comprises:

the first inner diameter is 0.001 inches larger than the outside diameter of the base of the cylindrical object; and the second inner diameter is 0.001-inches smaller than the outside diameter of the base of the cylindrical object.

3. The comparator device of claim 1, wherein said fixture includes a transverse positioning guide for the object holder, so that when the object holder is placed on the upwardly facing surface, the object holder is urged to a position centering the chamber opening so that it is aligned to the probe.

4. The comparator device of claim 3, wherein the transverse positioning guide is a transverse notch, running longitudinally and having an upwardly facing surface that coincides with the upwardly facing surface of the fixture, and wherein the object holder fits into the transverse notch so that the chamber opening is aligned to the probe.

5. The comparator device of claim 1 wherein the cylindrical chamber of the object holder is sized so that the base of the cylindrical object extends outside of the second end of the cylindrical chamber, when the cylindrical object is inserted fully into the cylindrical chamber.

6. The comparator device of claim 1 adapted to measure a cylindrical object type that is one out of a set consisting essentially of a bullet, a cartridge or a side arm projectile.

7. The comparator device of claim 1, wherein the object holder is round in transverse dimension.

8. The comparator device of claim 1, wherein the cylindrical chamber is a first cylindrical chamber having a central axis and the ring of the cylindrical chamber forms a second wall and the second wall defines a second cylindrical chamber aligned to the central axis of first cylindrical chamber.

9. The device of claim 1, wherein the indicator is coupled to the mounting element and the mounting element supports the probe of the indicator, the probe of the indicator having a spring, the spring configured to push the tip of the probe toward the stop element.

10. A method of measuring a cylindrical object having a base and a rounded nose, comprising:

(a) providing a comparator device, including:

(i) a fixture having a longitudinal upwardly facing surface and including a mounting element on a first longitudinal end of the upwardly facing surface and a stop element at a second longitudinal end of the surface, opposed to the first end;

(ii) an indicator that is coupled to the mounting element and configured so the probe of the indicator can move parallel to the upwardly facing surface, toward the stop element; and (iii) at least one object holder having a first end and a second end and defining a cylindrical chamber, open at the second end and having a first inner diameter, and having a ring having a second inner diameter, smaller than the first inner diameter, inward of the second end, and the chamber configured to receive the cylindrical object so a circumference of the nose abuts the ring and the base is aligned to and accessible to the probe;

(b) placing a cylindrical object into the object holder and placing the object holder onto the upwardly facing surface so that the first end abuts the stop element so as to prevent movement away from the indicator, and the second end faces the indicator so that the cylindrical object is accessible to the probe; and (c) bringing the probe into contact to the base and reading the indicator.

11. The method of claim 10, wherein said fixture includes a transverse positioning guide for the object holder, so that when the object holder is placed on the upwardly facing surface, the object holder is urged to a position centering the chamber opening so that it is aligned to the probe.

12. The method of claim 10, wherein the transverse positioning guide is a transverse notch, running longitudinally and having an upwardly facing surface that coincides with the upwardly facing surface of the fixture, and wherein the object holder fits into the transverse notch so that the chamber opening is aligned to the probe.

13. The method of claim 10, wherein the probe is spring loaded so that bringing the probe in contact with the base of the cylindrical object includes pushing the object into abutting contact with the ring.

* * * * *